United States Patent [19]

Ueno et al.

[11] Patent Number: 4,601,911

[45] Date of Patent: Jul. 22, 1986

[54] METHOD FOR INCREASING HYDROPHILICITY OF A FABRIC MATERIAL OF SYNTHETIC FIBERS

[75] Inventors: Susumu Ueno; Hirokazu Nomura, both of Ibaraki; Shinobu Hashizume; Toshiaki Nishide, both of Fukui, all of Japan

[73] Assignees: Shin-Etsu Chemical Co., Ltd.; Emori & Co. Ltd.; Nikka Chemical Ind. Co., Ltd., all of Japan

[21] Appl. No.: 743,505

[22] Filed: Jun. 11, 1985

[30] Foreign Application Priority Data

Mar. 12, 1982 [JP] Japan ..... 57-212385
Mar. 12, 1982 [JP] Japan ..... 57-212386

Related U.S. Application Data

[63] Continuation-in-part of Ser. No. 692,334, Jan. 17, 1985, abandoned, which is a continuation of Ser. No. 557,659, Dec. 2, 1983, abandoned.

[51] Int. Cl.[4] ..... B05D 1/00

[52] U.S. Cl. ..... 427/34; 427/393.1; 204/68

[58] Field of Search ..... 427/34, 393.1; 204/68

[56] References Cited

FOREIGN PATENT DOCUMENTS 111795A 6/1984 European Pat. Off. .
59-106567 7/1984 Japan .
59-106568 7/1984 Japan .

*Primary Examiner*—Richard Bueker
*Attorney, Agent, or Firm*—Toren, McGeady, Stanger, Goldberg & Kiel

[57] ABSTRACT

Hydrophilicity of a poorly hydrophilic fabric material of synthetic fibers can be remarkably and durably increased by the synergistic effect of the treatments first with a specific hydrophilic agent, e.g. water-absorbent agent and antistatic agent, and then by exposure to low temperature plasma generated in an atmosphere of oxygen or oxygen-containing gaseous mixture so that the capacity of the fabric material for water absorption is greatly increased and the antistatic performance thereof is greatly improved with decreased surface resistivity and charge voltage induced by rubbing.

2 Claims, 1 Drawing Figure

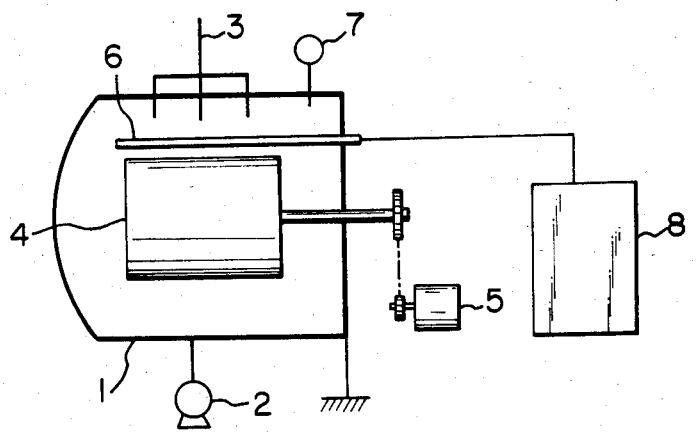
3
7
6
4
8
5
1
2

METHOD FOR INCREASING HYDROPHILICITY OF A FABRIC MATERIAL OF SYNTHETIC FIBERS

BACKGROUND OF THE INVENTION

This is a continuation-in-part application from a copending U.S. application Ser. No. 692,334 filed Jan. 17, 1985 now abandoned, which was a continuation of Ser. No. 557,659 filed 12-2-83, now abandoned.

The present invention relates to a method for increasing hydrophilicity of a fabric material of, in particular, synthetic fibers. More particularly, the invention relates to a method for imparting a durably increased capacity of water absorption and a durably decreased susceptibility to accumulation of static electricity to a fabric material of or mainly composed of synthetic fibers.

Needless to say, fabric materials currently on use both in the clothing use of people and in the industrial applications are in a very large part produced of synthetic fibers replacing the conventional or traditional natural fibers more and more by virtue of many advantages thereof. One of the largest differences between the properties of the synthetic and natural fibers is in the hydrophilicity-hydrophobicity behavior of them, the former fibers being of course outstandingly less hydrophilic than the latter. The remarkably small hydrophilicity of synthetic fibers sometimes causes serious problems not encountered in the use of natural fibers.

For example, fabric materials made of synthetic fibers have a very poor capacity of water or sweat absorption, which is advantageous on one hand but disadvantageous on the other, so that wearers of clothes made of synthetic fibers unavoidably have an unpleasant feeling of heavy stuffiness especially when the clothes are underwears worn in contact with or in the proximity of the skin of the wearer in a hot and humid climate.

Another serious problem caused by the poor hydrophilicity of synthetic fibers is the great accumulation of static electricity on the fibers. Even by setting aside the unpleasantness given to the wearer of clothes of synthetic fibers in such a charged condition with static electricity, many troubles are caused by the static electricity accumulated on the fibers such as the disturbance of the laborer's works in plants, danger of fire or explosion by the spark discharge of the accumulated static electricity, erroneous performance of computers and other delicate electronic instruments due to the influence of the strong electric field around the charged fabric materials and so on.

Many attempts have of course been proposed and practiced in the prior art to solve these problems by increasing the hydrophilicity of the fabric materials of synthetic fibers. For example, the problem of poor water absorption of synthetic fibers can be mitigated by the mixed spinning or mixed weaving with water-absorptive natural fibers. The effectiveness of this method is, however, limited since too much amounts of the natural fibers mixed with the synthetic fibers to attain sufficient hydrophilicity of the fabric material naturally result in the loss of the advantages inherent to synthetic fibers. An alternative method is the treatment of the fabric material of synthetic fibers with a water-absorbent agent to impart hydrophilicity to the surface of the fibers. Extensive investigations have been and are being undertaken in this direction to propose various kinds of water-absorbent agents effective for a particular type of synthetic fibers. For example, the capacity of water absorption of polyester fibers, e.g. polyethylene terephthalate fibers, can be increased by the treatment with a water-soluble polyester resin. Unfortunately, such a method of the treatment of synthetic fibers with a water-soluble resin is defective in several respects of the poor durability of the effects obtained therewith and the adverse influences on the color fastness of dyed fabric materials in many cases.

Limiting the matter to the antistatic treatment or decrease of accumulation of static electricity on the synthetic fibers, various antistatic agents have been proposed hitherto. For example, the above mentioned water-soluble resins including water-soluble polyester resins, polyurethane resins, polyacrylamide resins, polyamide resins and the like are of course effective as an antistatic agent with certain durability. Besides, many compounds are known to be effective as an antistatic agent including inorganic salts such as calcium chloride and lithium chloride, guanidine compounds such as guanidine hydrochloride, surface active agents such as those of the types of quaternary ammonium salts and phosphoric acid esters, acrylic polymers having quaternary cationic groups and the like although the effectiveness of the treatment with these compounds is rather temporary.

The durability of the effects obtained with the above described antistatic agents is, however, not quite satisfactory even with the relatively durable polymeric antistatic agents and the antistatic effects obtained therewith are decreased in the long-run use of the treated fabric materials even by setting aside the other problem of the insufficient effectiveness of the method. Furthermore, the method is also not free from the problem of the decreased color fastness of dyed fabric materials giving limitations to the amount and the manner of use of the antistatic agents.

In short, none of the prior art methods by use of a hydrophilic agent, i.e. water-absorbent agent or antistatic agent, is quite satisfactory for imparting hydrophilicity to the fabric materials of or mainly composed of a synthetic fiber in respects of the effectiveness and the durability.

SUMMARY OF THE INVENTION

It is therefore an object of the present invention to provide a novel and effective method for imparting remarkably strong and durable hydrophilicity to a fabric material of or mainly composed of a synthetic fiber so that the fabric material is imparted with increased capacity of water absorption and decreased susceptibility toward accumulation of static electricity.

Thus, the method of the present invention developed as a result of the extensive investigations by the inventors with the above described object compsrises the successive steps of:

(a) treating a fabric material of or mainly composed of a synthetic fiber with a hydrophilic agent to form a layer thereof on the fiber, and (b) then exposing the thus treated fabric material to low temperature plasma generated in an atmosphere of an inorganic gas under a pressure in the range from 0.01 to 10 Torr.

It has been established by the further continued investigations that a particularly excellent result of the low temperature plasma treatment in the above step (b) can be obtained only when the hydrophilic agent used in the step (a) is a compound of a specific type selected from the class consisting of (i) water-soluble acrylic polymers having quaternary-ammonium cationic pendant groups, (ii) water-soluble polyethyleneglycol-grafted cellulose polymers, (iii) water-soluble polyester resins and (iv) water-soluble polyurethane resins.

BRIEF DESCRIPTION OF THE DRAWING

The FIGURE is a schematic illustration of an apparatus used for the treatment of the fabric material with low temperature plasma.

DETAILED DESCRIPTION OF THE PREFERRED EMBODIMENTS

As is mentioned above, the method of the present invention is applicable to a fabric material of or mainly composed of a synthetic fiber. The synthetic fiber here implied includes polyester fibers, nylon fibers, acrylic fibers, polypropylene fibers, cellulose acetate fibers, polyvinyl alcohol fibers and the like. The fabric material may be composed of two kinds or more of these synthetic fibers as mixed-spun or mixed-woven. Furthermore, the fabric material may contain natural fibers provided that the weight proportion of the synthetic fibers in the fabric material is at least 50% since the effectiveness of the inventive method is less remarkable when the fabric material contains more than 50% of natural fibers. The form of the fabric material is not particularly limitative including woven and knit cloths and non-woven fabrics as well as threads and yarns.

The first step of the inventive method is the treatment of the fabric material with a hydrophilic agent which may be a water-absorbent agent or an antistatic agent known in the art. The hydrophilic agents of the water-absorbent type are exemplified by water-soluble polyethyleneglycol-grafted cellulose polymers, water-soluble polyester resins, water-soluble urethane resins, water-soluble silicone resins, water-soluble polyamide resins and the like. The hydrophilic agents of the antistatic type are mostly surface active agents of the cationic, anionic, non-ionic and amphoteric types. Examples of the cationic surface active agents include salts of primary, secondary and tertiary amines, quaternary ammonium salts, pyridinium salts, acrylic polymers having quaternary-ammonium cationic pendant groups and the like and the anionic surface active agents are exemplified by sulfonated oils, soaps, sulfonated ester oils, sulfonated amide oils, ester salts of sulfonated olefins, ester salts of sulfonated aliphatic alcohols, ester salts of alkyl sulfates, salts of fatty acid ethyl sulfonic acids, salts of alkyl sulfonic acids, salts of alkylnaphthalene sulfonic acids, salts of alkylbenzene sulfonic acids, sulfonic acid salts of succinic acid esters, salts of phosphoric acid esters and the like. The non-ionic surface active agents are exemplified by carboxylic acid esters of polyhydric alcohols, ethylene oxide adducts of aliphatic alcohols, ethylene oxide adducts of fatty acids, ethylene oxide adducts of aliphatic amines and amides, ethylene oxide adducts of alkylphenols, ethylene oxide adducts of alkylnaphthols, ethylene oxide adducts of partial fatty acid esters of polyhydric alcohols, block copolymers of ethylene oxide and propylene oxide, grafted celluloses, water-soluble polyester resins and the like and the amphoteric surface active agents are exemplified by carboxylic acid derivatives, imidazoline derivatives and the like.

As is mentioned before, particularly preferable hydrophilic agents among the above named ones are (i) water-soluble acrylic polymers having quaternary-ammonium cationic pendant groups, (ii) water-soluble polyethyleneglycol-grafted cellulose polymers, (iii) water-soluble polyester resins and (iv) water-soluble urethane resins. In the following, descriptions are given of these specific hydrophilic agents.

The water-soluble acrylic polymer having quaternary-ammonium cationic pendant groups belonging to the first class of the preferable hydrophilic agents is represented by the general formula $$\left(CH_2-\underset{\substack{|\\ CO-O-C_2H_4N^+R^1_3}}{CR}\right)_m\left(CH_2-\underset{\substack{|\\ CO-O-R^2}}{CR}\right)_n, \quad \text{(I)}$$

in which each of R and $R^1$ is a hydrogen atom or a lower alkyl group which is methyl or ethyl group, $R^2$ is an alkyl group having from 4 to 18 carbon atoms and m and n are each a positive integer with the proviso that m:n is in the range from 1:1 to 5:1 or, preferably, from 1:1 to 2:1. Several commercial products of this type are available, of which Nicepole FH (a product by Nikka Chemical Co., Japan) gives quite satisfactory results.

The water-soluble polyethyleneglycol-grafted cellulose polymer belonging to the second class of the preferable hydrophilic agent is a cellulose derivative comprising the moieties represented by the general formula, denoting the monomeric moiety of cellulose by —Cell—, $$\left(\underset{\substack{|\\ (CH_2-\underset{\substack{|\\ CO-O(C_2H_4-O)_qR^3}}{CMe}-)_p}}{Cell}\right), \quad \text{(II)}$$

in which Me is a methyl group, $R^3$ is a lower alkyl group which is methyl or ethyl group, p is a positive integer and q is a positive integer not exceeding 50. Several commercial products of this type are available, of which Nicepole TF-501 (a product by Nikka Chemical Co., Japan) gives quite satisfactory results.

The water-soluble polyester resins belonging to the third class of the preferable hydrophilic agents is a polymer represented by the general formula $$HO-CO-R^4-CO-R^5-O)_rH, \quad \text{(III)}$$

in which $R^4$ is a divalent hydrocarbon group selected from the class consisting of phenylene group $—C_6H_4—$, ethylene group $—C_2H_4—$ and hexamethylene group $—C_6H_{12}—$, $R^5$ is a divalent hydrocarbon group of ethylene group $—C_2H_4—$ or propylene group $—C_3H_6—$, r is a positive integer in the range from 15 to 200 or, preferably, from 30 to 100 and s is a positive integer. The hydroxy group at the molecular chain terminal may be carboxylated. Several commercial products of this type are available, of which Nicepoles PR-333 and PR-555 (products by Nikka Chemical Co., Japan) give quite satisfactory results.

The water-soluble urethane resin as the fourth class of the preferable hydrophilic agents is also known in the art and polyurethane resins can be imparted with solublity in water when the molecular structure thereof contains substantial amount of polyoxyalkylene linkages. Typical water-soluble urethane resins comprise following units of the formula:

$$[-CONH-R'-(NHCO-OR^5)_{n2}N^+R^6-CH_2CH_2-N[-(R^5O)_tCONH-R'-NHCO-]_2, \quad (IVa)$$

or $$-CONH-R'-NHCO-(O-R^5O)_uCONH-R'-NHCO-, \quad (IVb)$$

in which $R^5$ is an ethylene $-C_2H_4-$ and/or propylene $-C_3H_6-$ groups, R' is a divalent hydrocarbon group selected from the class consisting of hexamethylene, tolylene and biphenylene groups, t is a positive integer of from 5 to 35 and u is a positive integer of from 2 to 140. Several commercial products of these types are available, of which Evafanol As-1 (a product by Nikka Chemical Co.) has the structural units of the formula (IVa) and Evafanol N (a product by the same company supra) has the structural units of the formula (IVb). These water-soluble urethane resins are used usually in combination with a curing catalyst which is preferably an organic tin compound of the formula $(BuO-)_2Sn(-O-CODd)_2$, Bu and Dd being a butyl group and a dodecyl group, respectively, available, for example, under a tradename of Evafanol CS (a product by the same company supra).

The method for performing the treatment of a fabric material with the above mentioned hydrophilic agent is conventional and an aqueous solution of the hydrophilic agent in a concentration of 0.5 to 2% by weight, if necessary, with admixture of the curing catalyst is applied to the fabric material usually by dipping or by padding followed by heating for drying and, eventually, curing.

The next step, i.e. step (b), in the inventive method is the treatment of the fabric material after the treatment with the hydrophilic agent by exposure to an atmosphere of low temperature plasma.

The procedure of the low temperature plasma treatment is also well known in the art. That is, the fabric material of synthetic fibers under treatment is placed inside a plasma chamber capable of being evacuated to a reduced pressure and equipped with two or two sets of discharge electrodes, one or one set thereof being grounded and the other or the other set thereof serving as a power electrode, and low temperature plasma is generated inside the plasma chamber by supplying an electric power to the electrodes with impression of a voltage of, for example, 400 volts or higher while the atmosphere inside the plasma chamber is kept under a reduced pressure with a stream of an inorganic gas.

Suitable inorganic gases to fill the plasma chamber under a reduced pressure are exemplified by helium, neon, argon, nitrogen, oxygen, air, nitrous oxide, nitrogen monoxide, nitric oxide, carbon monoxide, carbon dioxide, bromine cyanide, sulfur dioxide, hydrogen sulfide and the like. These inorganic gases may be used either alone or as a mixture of two kinds or more according to need. In particular, it is preferable in the inventive method that the inorganic gas is an oxidizing gas which may be oxygen or a gaseous mixture containing at least 10% by volume of oxygen.

The pressure of the gaseous atmosphere inside the plasma chamber is preferably in the range from 0.01 to 10 Torr. Low temperature plasma is readily generated with stability by the glow discharge in the atmosphere under a pressure in this range by supplying an electric power of, for example, 10 watts to 100 kilowatts at a frequency of 10 kHz to 100 MHz between the electrodes installed inside the plasma chamber although the frequency is not particularly limited to the above mentioned high frequency range but may be direct current, low frequency or a frequency of microwave range. The electrodes are not necessarily installed inside the plasma chamber but may be installed outside the plasma chamber or may be replaced with a single work coil for high frequency surrounding the plasma chamber although installation of the discharge electrodes inside the plasma chamber is preferable from the standpoint of obtaining effective results of the low temperature plasma treatment. These electrodes are connected to the power source, e.g. high frequency generator, either by capacitive coupling or by inductive coupling.

The forms of the electrodes are also not particularly limitative and the power electrode and the grounded electrode may be of the same form or different forms from each other. Plate-like, ring-like, rod-like and cylindrical electrodes are equally suitable though dependent on the particular requirements. A convenient design of the discharge electrodes is that the walls of the plasma chamber are made of a metal to serve as a grounded electrode and a power electrode of a suitable form is installed inside the plasma chamber as insulated from the chamber walls. Assuming that the electrodes are installed inside the plasma chamber, the distance between the grounded and power electrodes is preferably in the range from 1 to 30 cm or, more preferably, from 2 to 10 cm in order to obtain higher efficiency of the treatment.

The material of the electrodes should of course be conductive and copper, iron, stainless steel, aluminum and the like metals are suitable as the material of the electrodes. In order to ensure stability of the discharge between the electrodes, it is preferable that the surface of the electrodes or, in particular, the power electrode is provided with a heat-resistant and electrically insulating coating layer of, for example, porcelain enamel, glass or ceramic having a dielectric strength or breakdown voltage of, desirably, at least 1000 volts/mm.

It is a very remarkable and distinctive advantage that the excellent hydrophilicity of the fabric materials of synthetic fibers obtained in the above described method of the invention is highly durable without decreasing the color fastness of dyed fabric materials.

In the following, examples are given to illustrate the inventive method and the effectiveness thereof in more detail but not to limit the scope of the invention in any way.

The apparatus for the low temperature plasma treatment used in the following examples is illustrated in the accompanying drawing. In the FIGURE, the plasma chamber 1 is made of a stainless steel and capable of being evacuated by means of the vacuum pump 2 down to a pressure of 0.01 Torr or below. The plasma chamber 1 is provided with a gas inlet 3 through which a gas is introduced into the plasma chamber 1 to constitute the gaseous atmosphere inside the chamber 1. The open end of the gas inlet 3 is branched in manifold (in three branches in the FIGURE) to ensure uniformity of the atmospheric condition inside the chamber 1. A stainless steel-made rotatable cylindrical electrode 4 inside the plasma chamber 1 is supported vacuum-tightly by a faceplate of the plasma chamber 1 in a cantilever manner and driven by an electric motor 5 installed outside the chamber 1 at a controllable velocity. The rotatable cylindrical electrode 4 is electrically grounded through the walls of the plasma chamber 1. The temperature of the rotatable cylindrical electrode 4 can be controlled by passing a heating or cooling medium through inside. Facing the rotatable cylindrical electrode 4, a rod-like electrode 6, which serves as a power electrode, is held in parallel to the rotating axis of the rotatable cylindrical electrode 4 to form a gap of uniform width therebetween. The power electrode 6 is, of course, electrically insulated from the walls of the plasma chamber 1 and connected to the ungrounded terminal of a high frequency generator 8. The pressure inside the plasma chamber 1 can be determined by means of a Pirani gauge 7 connected to the chamber 1.

EXAMPLE 1

A woven cloth of pure polyester fiber was subjected to a hydrophilic treatment with either one of the following hydrophilic agents I to III by the padding method of 1 dipping-1 nipping with an aqueous solution of the respective water-absorbent agent to give a pick-up of 68% by weight followed by drying at 110° C. for 3 minutes and curing at 180° C. for 30 seconds.

I: a water-soluble polyester resin (Nicepole PR-555, a product by Nikka Chemicl Co.) in a 5% aqueous solution II: a water-soluble urethane resin (Evafanol AS-1, a product by the same company) in a 5% aqueous solution combined with a 0.5% aqueous solution of an organic tin compound (Evafanol CS, a product by the same company) as a catalyst III: a water-soluble urethane resin (Evafanol N, a product by the same company) in a 5% aqueous solution combined with a 1% aqueous solution of a catalyst (Evafanol CS, a product by the same company)

A test cloth of 30 cm by 30 cm wide taken by cutting each of the thus treated cloths and the same cloth before the treatment with the hydrophilic agent was spread and fixed on the rotatable cylindrical grounded electrode of the plasma apparatus as described before and the plasma chamber was evacuated. When the pressure inside the chamber had reached 0.03 Torr, oxygen was continuously introduced into the chamber at a rate of 0.5 liter/minute so that the pressure inside the plasma chamber was maintained at 0.07 Torr by the balance of the continuous evacuation and introduction of the oxygen gas.

While keeping the atmospheric conditions as described above, low temperature plasma was generated for 150 seconds inside the chamber by supplying a high frequency electric power of 3 kilowatts at a frequency of 110 kHz to the electrodes to expose the surface of the cloth to the atmosphere of low temperature plasma. This procedure was repeated with the cloth reversed on the electrode surface to expose the other surface of the cloth to the plasma atmosphere.

For comparison, the order of the treatments with the hydrophilic agent and with the low temperature plasma was reversed by undertaking the plasma treatment prior to the hydrophilic treatment.

The thus treated test cloths were subjected to the test for the evaluation of the capacity of water absorption according to the procedure of the method A, i.e. dropping method, specified in JIS L 1096 to give the results shown in Table 1. The test was undertaken for each cloth either as treated or after 50 times of repeated laundering each with an aqueous solution of 1 g/liter concentration of a synthetic detergent (ZAB, a product by Kao Soap Co.) in a bath ratio of 1:30 at 40° C. for 10 minutes followed by rinse and dehydration.

TABLE 1

Unit:seconds

| Example No. | Hydrophilic agent | Hydrophilic treatment only | | Hydrophilic treatment → plasma treatment | | Plasma treatment → hydrophilic treatment | |
|---|---|---|---|---|---|---|---|
| | | Before laundering | After laundering | Before laundering | After laundering | Before laundering | After laundering |
| 1 | None | (>180) | (>180) | 0.5 | 20 | — | — |
| | I | 2 | 30 | 0.5 | 1 | 0.5 | 10 |
| | II | 1 | >180 | 0.5 | 1 | 1 | 60 |
| | III | 15 | 60 | 0.5 | 1 | 2 | 15 |
| 2 | None | 15 | 40 | 0.5 | 12 | — | — |
| | I | 1 | 8 | 0.5 | 0.5 | 0.5 | 4 |
| | II | 1 | 34 | 0.5 | 0.5 | 1 | 10 |
| | III | 1 | 12 | 0.5 | 0.5 | 1 | 7 |

EXAMPLE 2

The experimental procedure was substantially the same as in Example 1 except that the atmosphere of the low temperature plasma was maintained under a pressure of 0.1 Torr by continuously introducing a 1:3 by volume gaseous mixture of oxygen and argon at a rate of 1 liter/minute and the low temperature plasma was generated for 60 seconds by supplying an electric power of 5 kilowatts to the electrodes. The material of the test cloth in this example was a polyester/cotton mixed-spun gaberdine fabric in a mixing ratio of 65:35. The results of the test for the capacity of water absorption undertaken in the same manner as in Example 1 are shown in Table 1.

EXAMPLE 3

A woven cloth of pure polyester fiber dyed in blue with 4% (o.w.f.) of Dianix Blue BG-FS was treated in advance with either one of 8 kinds of the antistatic agents shown below each by padding of 1 dipping-1 nipping with an aqueous solution of the agent to give a pick-up of 68% by weight followed by drying at 110° C. for 3 minutes and curing at 180° C. for 30 seconds.

I: a quaternary-ammonium cationic acrylic polymer of the formula (I), in which R and $R^1$ are each a methyl group, $R^2$ is an octadecyl group and m:n is 1.4:1

II: similar to I above but with m:n equal to 2:1

III: similar to I above but with m:n equal to 5:1

IV: a water-soluble grafted cellulose of the formula (II) in which $R^3$ is a methyl group and q is 23

V: similar to IV but with q equal to 10

VI: a water-soluble polyester resin of the formula (III), in which $R^4$ is a phenylene group, $R^5$ is an ethylene group and r is 90

VII: similar to VI above but with r equal to 14

VIII: similar to VI above but with r equal to 140

Each of the thus treated test cloths and the same cloth before the treatment with the antistatic agent was subjected to the treatment with low temperature plasma. The conditions of the plasma treatment were substantially the same as in Example 1 except that the atmosphere for the plasma generation was kept under a pressure of 0.13 Torr by continuously introducing oxygen gas at a rate of 1.5 liters/minute and the length of the treatment time was 200 seconds.

The thus plasma-treated test cloths as well as the same test cloths before the plasma treatment, i.e. with the hydrophilic treatment alone, were subjected to the measurements of the surface resistivity in ohm and the charge voltage induced by rubbing in volts either as treated or after 50 times of repeated laundering in the same conditions as in Example 1. The results are shown in Table 2 below. The measurement of the surface resistivity of the test cloths was undertaken by use of an ultrainsulation resistance tester (Model SM-5 manufactured by Toa Denpa Kogyo Co.) at 20° C. in a room of 40% relative humidity and the charge voltage by rubbing was measured by use of a rotary static tester manufactured by Koa Shokai Co. under the same atmospheric conditions as above.

TABLE 2

| Hydrophilic agent | Hydrophilic treatment only | | | | Hydrophilic treatment → plasma treatment | | | |
|---|---|---|---|---|---|---|---|---|
| | Surface resistivity, ohm | | Charge voltage by rubbing, volts | | Surface resistivity, ohm | | Charge voltage by rubbing, volts | |
| | Before laundering | After laundering | Before laundering | After laundering | Before laundering | After laundering | Before laundering | After laundering |
| None | $>2 \times 10^{13}$ | — | 4900 | — | $>2 \times 10^{13}$ | — | 5300 | — |
| I | $5 \times 10^{6}$ | $>2 \times 10^{13}$ | 24 | 4200 | $3 \times 10^{6}$ | $5 \times 10^{11}$ | 22 | 1300 |
| II | $6 \times 10^{6}$ | $>2 \times 10^{13}$ | 25 | 4600 | $3 \times 10^{6}$ | $9 \times 10^{11}$ | 25 | 2200 |
| III | $6 \times 10^{6}$ | $>2 \times 10^{13}$ | 24 | 4500 | $7 \times 10^{6}$ | $1.5 \times 10^{12}$ | 31 | 3500 |
| IV | $8 \times 10^{10}$ | $3 \times 10^{12}$ | 580 | 2400 | $5 \times 10^{10}$ | $9 \times 10^{10}$ | 540 | 600 |
| V | $1 \times 10^{11}$ | $5 \times 10^{12}$ | 780 | 2700 | $8 \times 10^{10}$ | $1 \times 10^{11}$ | 620 | 720 |
| VI | $3 \times 10^{10}$ | $8 \times 10^{10}$ | 180 | 630 | $3 \times 10^{10}$ | $6 \times 10^{10}$ | 150 | 420 |
| VII | $5 \times 10^{10}$ | $2 \times 10^{11}$ | 210 | 1200 | $4 \times 10^{10}$ | $2 \times 10^{11}$ | 170 | 1090 |
| VIII | $7 \times 10^{10}$ | $2 \times 10^{11}$ | 240 | 1200 | $6 \times 10^{10}$ | $4 \times 10^{11}$ | 210 | 1250 |

What is claimed is:

1. A method for increasing hydrophilicity of a fabric material of or mainly composed of a synthetic fiber which comprises the successive steps of:
   (a) treating the fabric material with a hydrophilic agent to form a layer thereof on the fiber, the hydrophilic agent being selected from the class consisting of (i) water-soluble acrylic polymers having quaternary-ammonium cationic pendant groups, (ii) water-soluble polyethyleneglycol-grafted cellulose polymers, (iii) water-soluble polyester resins and (iv) water-soluble polyurethane resins; and
   (b) then exposing the thus treated fabric material to low temperature plasma generated in an atmosphere of an inorganic gas under a pressure in the range from 0.01 to 10 Torr.

2. The method as claimed in claim 1 wherein the inorganic gas is oxygen or a gaseous mixture containing at least 10% by volume of oxygen.

* * * * *